United States Patent [19]

Ono et al.

[11] Patent Number: 4,541,808

[45] Date of Patent: Sep. 17, 1985

[54] WATER JET PROPULSION SYSTEM

[75] Inventors: Hiromi Ono, Fujie Akashi; Takemi Inoue, Kakogawa, both of Japan

[73] Assignee: Kawasaki Jukogyo Kabushiki Kaisha, Kobe, Japan

[21] Appl. No.: 332,273

[22] Filed: Dec. 18, 1981

[30] Foreign Application Priority Data

Dec. 18, 1980 [JP] Japan ..... 55-179936

[51] Int. Cl.[4] ..... B63H 11/10

[52] U.S. Cl. ..... 440/42

[58] Field of Search ..... 440/38, 40, 41, 42, 440/43, 47; 60/221, 222; 114/151; 415/142, 213 C; 416/244 B

[56] References Cited

U.S. PATENT DOCUMENTS 3,187,708 6/1965 Fox ..... 440/41
3,839,859 10/1974 Woell ..... 440/38
3,906,886 9/1975 Elger ..... 440/38

FOREIGN PATENT DOCUMENTS 724662 11/1966 Italy ..... 440/38
463881 4/1937 United Kingdom ..... 440/43

*Primary Examiner*—Jesûs D. Sotelo
*Attorney, Agent, or Firm*—Jordan and Hamburg

[57] ABSTRACT

A water jet propulsion system for watercraft having an impeller, especially a conical oblique flow impeller with an increased outer diameter in going toward the downstream side. The impeller is secured to a transmission shaft which is journalled by bearings in a hub of fixed blades and formed at its end portion with spline grooves being able to fit in spline strips formed at the forward end portion of a drive shaft. This allows a pump portion of the water jet propulsion system to be assembled outside the watercraft and separately therefrom, so that positioning of the impeller with respect to its duct can be effected with a high degree of accuracy.

1 Claim, 3 Drawing Figures

WATER JET PROPULSION SYSTEM

BACKGROUND OF THE INVENTION

This invention relates to a water jet propulsion system for watercraft wherein pressure is applied by an impeller driven by a prime mover of the watercraft to water drawn through an opening at the rear portion of the bottom of the watercraft to eject jet streams of water rearwardly of the watercraft through fixed blades and a nozzle located downstream of the impeller, and more particularly it is concerned with improvements in or relating to a transmission for driving the impeller.

In this type of water jet propulsion system, the precision with which the impeller driven for rotation by a drive shaft of the prime mover for the watercraft is mounted on the drive shaft with respect to a duct surrounding the impeller for providing a path of flow of streams of water is a governing factor in increasing the efficiency with which propulsion of the watercraft is achieved by water jets. Thus it is imperative that positioning of the impeller be effected accurately. However, it is troublesome and time-consuming to carry out operation to obtain correct positioning, and particularly when the impeller is of the oblique flow type great difficulties are faced with.

SUMMARY OF THE INVENTION

This invention has been developed for the purpose of obviating the aforesaid disadvantage of the prior art. Accordingly the invention has as its object the provision of a water jet propulsion system for watercraft which eliminates the aforesaid difficulties with which the prior art is faced with and enables the operation of mounting an impeller on the drive shaft with respect to the duct to be carried out relatively readily and positively.

To accomplish the aforesaid object, the invention proposes to provide the watercraft with a transmission shaft journalled in a hub of the fixed blades and having the impeller secured thereto, the transmission shaft being connected at its forward end portion with the rear end portion of a drive shaft for the prime mover.

In the water jet propulsion system according to the invention, the drive shaft and the transmission shaft constitute a transmission mechanism and the two shafts are joined to each other by connection means. This allows a pump portion of the water jet propulsion system to be assembled outside the watercraft and separately therefrom, so that positioning of the impeller with respect to the duct can be effected with a high degree of accracy. Particularly the invention offers the additional advantage that a watercraft can mount a water jet propulsion system having a pump of the oblique flow type which is compact in size and high in propulsion efficiency although it is slightly complex in construction.

DETAILED DESCRIPTION OF THE DRAWINGS

Figure 1:
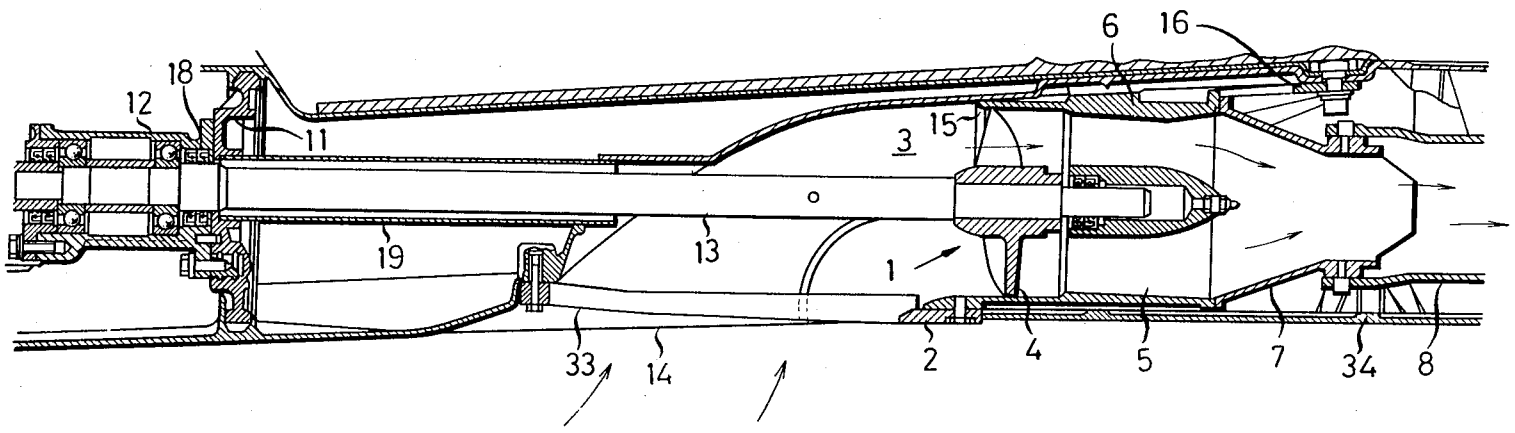
FIG. 1 PRIOR ART
FIG. 1 is a vertical sectional view of a water jet propulsion system of the axial flow pump type of the prior art.
Figure 2:
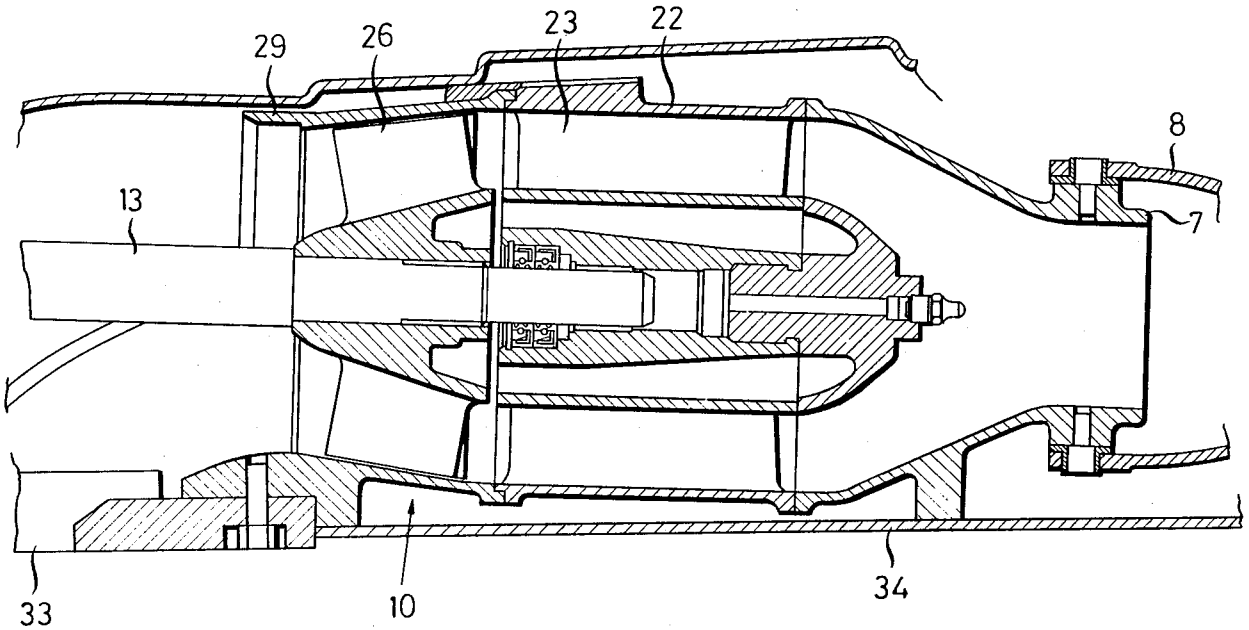
FIG. 2 PRIOR ART
FIG. 2 is a vertical sectional view of a water jet propulsion system of the oblique flow pump type of the prior art.

Water jet propulsion systems of the prior art will be first outlined by referring to FIGS. 1 and 2.

Referring to FIG. 1, a water jet propulsion system generally designated by the numeral 1 is mounted in a recess 3 in a rear portion 2 of the bottom of a watercraft and comprises an impeller 4, fixed blades 5, a duct 6 enclosing the impeller 4 and fixed blades 5 and providing a path of the streams of water, a nozzle 7, and a direction-changing nozzle 8. Water is drawn through an opening 14 formed in the rear portion 2 of the bottom of the watercraft and pressurized by the impeller 4 driven by a drive shaft 13 of a prime mover, not shown, mounted in the central portion of a hull of the watercraft, so that the pressurized water is ejected through the fixed blades 5 and nozzle 7 and from the rear end of the watercraft to provide a propulsion force for moving the watercraft forwardly. The numeral 33 designates a grid for removing foreign matter that might otherwise be introduced into the watercraft through the opening 14 together with the water, and the numeral 34 a cover provided to the underside of the propulsion system 1 for increasing the ability of the watercraft to glide smoothly on the water.

Generally, assembling of a water jet propulsion system provided with an axial flow impeller is carried out as follows. Firstly, the drive shaft 13 is watertightly held through a seal 18 by a portion of a bearing box 12 which is secured to a bulkhead 11 in the hull of the watercraft, and the impeller 4 is threadably connected in a predetermined position on the drive shaft 13 that extends through a sleeve 19 into the recess 3. Meanwhile the duct 6 formed integrally with the fixed blades 5 is connected to the nozzle 7 to provide a unitary structure which is inserted from the stern of the watercraft into the recess 3 and moved forwardly (leftwardly in the figure) along the drive shaft 13. At this time, adjustments of the position of the unitary structure are effected by using the impeller 4 secured to the shaft 13 as a reference through naked eyes or by using a gauge, so that a tip clearance 15 defined between the impeller 4 and duct 6 can be uniformly supported through the entire circumference or positioning of the impeller 4 can be effected accurately. Finally legs 16 connected to the duct 6 are bolted to the hull through a suitable number of shims.

In recent years, there has been a tendency to mount on watercraft an oblique flow pump of high propulsion efficiency to improve the performance of the watercraft, as illustrated in FIG. 2. The oblique flow pump 10 includes an oblique flow impeller 26 with an increased outer diameter in going toward the downstream side. Thus an impeller duct 29 also increases in size accordingly, and the upstream end of the duct of the impeller has an outer diameter smaller than the outer diameter of the downstream end of the impeller. Thus difficulties would be faced with in mounting this type of pump if the same steps are followed as followed in mounting an axial flow pump having a constant impeller diameter.

In view of the foregoing, it has been usual practice to split the duct into the impeller duct 29 and a fixed blade duct 22, and the impeller duct 29 alone is first fitted on the drive shaft 13 secured to the hull and then the fixed blade duct 22 and the nozzle 7 are mounted after the impeller 26 is bolted to the drive shaft 13. Thereafter the impeller duct 29, fixed blade duct 22 and nozzle 7 are secured in place by through bolts to provide a unitary structure, thus completing assembling.

Since the impeller duct of the oblique flow pump is conical in shape as described hereinabove, it would be impossible to watch with naked eyes the tip clearance of the impeller when the aforesaid unitary structure is mounted in the recess 3 on the bottom of the watercraft which is narrow and it would also be difficult to use a gauge for obtaining correct positioning. Thus difficulties would be faced with in effecting adjustments of the position in which the impeller 26 is mounted on the drive shaft 13 with respect to the duct.

In view of the foregoing problem faced with in the prior art, the invention calls for carrying out positioning of the impeller of an oblique flow pump, in particular, with respect to the impeller duct before they are mounted on watercraft and mounting the impeller on the drive shaft after the positioning of the impeller is achieved, so that the positioning operation can be carried out successfully without any trouble.

Figure 3:
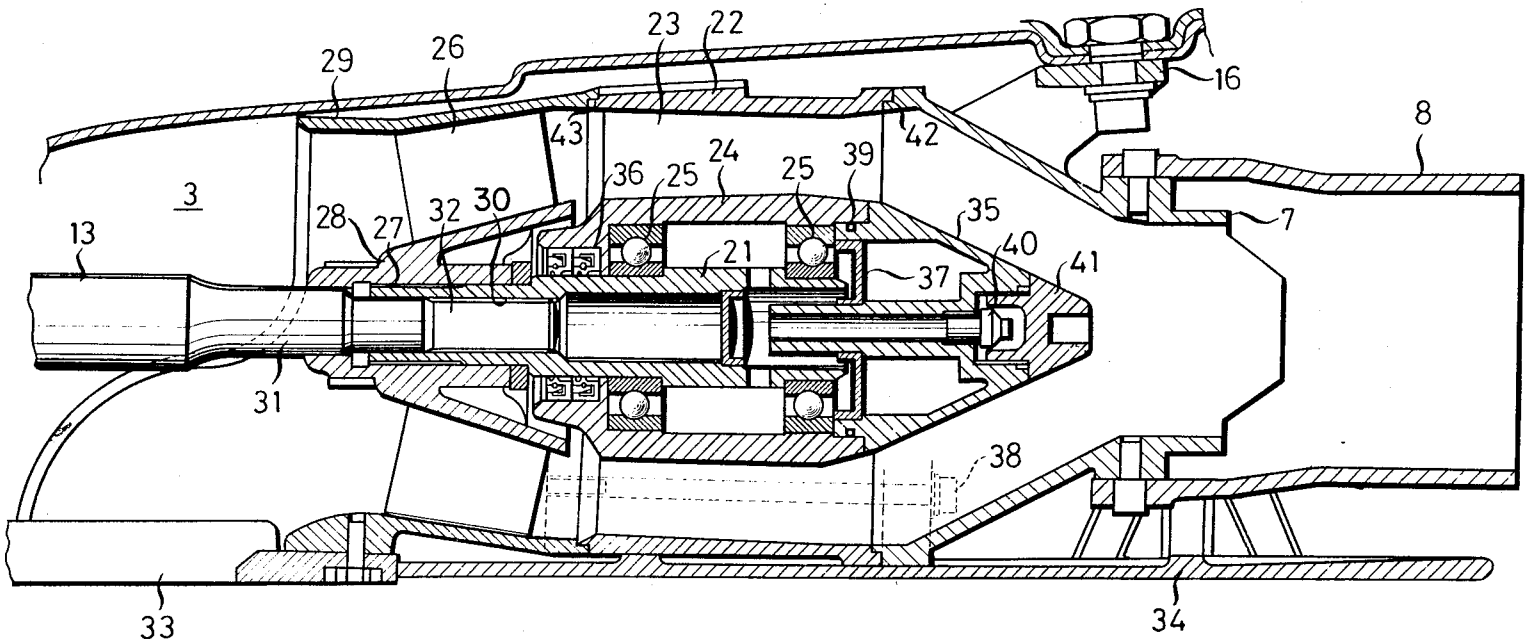
FIG. 3 is a vertical sectional view of a water jet propulsion system of the oblique flow pump type incorporating therein the transmission mechanism according to the invention.

A preferred embodiment of the invention will now be described by referring to FIG. 3 which shows a water jet propulsion system of the oblique flow pump type in which the invention is incorporated. In FIG. 3, parts similar to those shown in FIGS. 1 and 2 are designated by like reference characters and their description will be omitted.

Referring to FIG. 3, the numeral 21 designates a tubular transmission shaft journalled by bearings 25 in a hub 24 of fixed blades 23 formed integrally with the fixed blade duct 22. The oblique flow impeller 26 threadably connected to a transmission shaft portion projecting upstream of the hub 24 through a threaded portion 27 formed on the outer circumference of the shaft 21. The numeral 28 designates a hub of the impeller 26. The transmission shaft 21 is formed at an end portion thereof with a spline groove 30 in a position in which the oblique flow impeller 26 is located. The numeral 31 designates a forward end portion of the drive shaft 13 projecting into the recess 3 on the bottom of the watercraft which is watertightly supported by the bulkhead 11 (see FIG. 1) of the hull through the bearing box 12 and formed on its outer circumference with a spline strip 32 fitted in the spline groove 30.

Assembling of the system according to the invention of the aforesaid construction will now be described. The drive shaft 13 is connected to the prime mover and mounted in the hull in such a manner that it extends through the bulkhead into recess 3 in the rear portion of the bottom of the watercraft. Meanwhile the bearings 25 are inserted in the hub 24 of the fixed blades 23 formed integrally with the fixed blade duct 22, to journal the transmission shaft 21. This and the following operations are performed outside the watercraft. The impeller 26 is threadably connected to the transmission shaft 21 at the treaded portion 27 on the outer circumference thereof projecting upstream of the hub 24, and then the impeller duct 29 is placed on the oblique flow impeller 26 from the upstream side to enclose same. Thereafter the impeller duct 29, fixed blade duct 22 and nozzle 7 are secured to one another by through bolts 38, to provide a unitary pump body. An oil seal 36 is mounted between the forward end of the hub 24 on the upstream side thereof and the shaft 21, and an O-ring 39 is mounted between the rear end of the hub 24 and a tail cone 35 for providing a liquid tight seal to the bearings 25. The tail cone 35 has a grease nipple 40 threadably connected thereto, and a blind cover 41 is fitted to the grease nipple 40. 42, 43 designate socket and spigot joints. 37 is a guide plate secured to the tail cone 35 for introducing grease to the bearings 25.

The aforesaid unitary pump body can be assembled by interfitting its component parts in the same manner as a socket and spigot joint by using the machined surfaces thereof as references outside the watercraft. This eliminates the need to take measurements either with naked eyes or by using a gauge or facilitates such measurement taking, so that adjustments of the tip clearance of the impeller can be effected quite readily.

The unitary pump body thus assembled is inserted into the recess 3 on the bottom of the watercraft from the rear, and the spline groove 30 on the transmission shaft 21 is brought into fitting engagement with the spline strip 32 on the drive shaft 13. Then the pump body thus connected to the drive shaft 13 is secured to the hull by the legs 16, thereby allowing motive force to be transmitted from the drive shaft 13 to the oblique flow impeller 26 through the transmission shaft 21. Misalignment might arise between the transmission shaft 21 and the drive shaft 13 in case of securing the pump body to the hull. However, any misalignment could be accommodated by the flexing of the drive shaft 13 which is elongated or the play between the spline groove 30 and the spline strip 32, so that no problem would be raised. Besides, the pump body assembled unitarily beforehand can have its tip clearance maintained without any trouble.

The duct providing a path of the streams of water is preferably formed by portions of the hull at its area located upstream of the impeller duct.

Though the transmission shaft and the drive shaft are connected by the spline means with each other in the above-mentioned embodiment, screw connection means comprising a female screw formed in the transmission shaft and a male screw formed on the drive shaft or flange coupling means can be used instead of the spline means.

What is claimed is:

1. A water jet propulsion system for a watercraft comprising:

means defining a water flow path in the watercraft;

driving means including a prime mover situated in the watercraft and a driving shaft rotationally connected to said prime mover, said driving shaft extending into the water flow path and having first spline means at one end of the driving shaft located in the water flow path;

a duct assembly to be situated in the water flow path, said duct assembly including an impeller duct, a fixed blade duct having a plurality of fixed blades and a hub supported by said fixed blades in the center thereof, and a nozzle, said impeller duct, blade duct and nozzle being in turn located in the opposite direction relative to the stem of the watercraft and connected together;

a transmission shaft rotationally supported by and situated in the center of the hub, said transmission shaft having second spline means at one end to be engaged with the first spline means of the driving shaft; and an impeller connected to said transmission shaft to be rotated in the duct assembly, said impeller, transmission shaft and duct assembly being firstly preassembled outside the watercraft and then the duct assembly including the transmission shaft and impeller therein being fixed in the water flow path so that the first and second spline means are connected together to thereby provide easy installation of the impeller in the watercraft.

* * * * *